US006046899A

United States Patent [19]

Dougherty

[11] Patent Number: 6,046,899

[45] **Date of Patent: *Apr. 4, 2000**

[54] HYBRID PROTECTIVE RELAY HAVING ENHANCED CONTACT RESPONSE TIME

[75] Inventor: John J. Dougherty, Collegeville, Pa.

[73] Assignee: General Electric Company, Schenectady, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/909,675

[22] Filed: Aug. 12, 1997

[51] Int. Cl.[7] ..... H01H 9/30

[52] U.S. Cl. ..... 361/173; 361/160; 361/13; 361/104

[58] Field of Search ..... 361/8, 13, 160, 361/173, 104

[56] References Cited

U.S. PATENT DOCUMENTS

| | | | |
|---|---|---|---|
| 4,745,511 | 5/1988 | Kugelman et al. | 361/13 |
| 4,760,483 | 7/1988 | Kugelman et al. | 361/13 |
| 4,817,037 | 3/1989 | Hoffman et al. | 364/200 |
| 4,992,904 | 2/1991 | Spencer et al. | 361/5 |
| 5,057,962 | 10/1991 | Alley et al. | 361/24 |
| 5,079,457 | 1/1992 | Lu | 307/632 |
| 5,162,682 | 11/1992 | Lu | 307/631 |
| 5,283,706 | 2/1994 | Lillemo et al. | 361/13 |
| 5,338,991 | 8/1994 | Lu | 307/632 |
| 5,536,980 | 7/1996 | Kawate et al. | 307/116 |
| 5,699,218 | 12/1997 | Kadah | 361/13 |

*Primary Examiner*—Fritz Fleming
*Attorney, Agent, or Firm*—Thomas M. Blasey; Damian G. Wasserbauer; Carl B. Horton

[57] ABSTRACT

A protective relay of the type consisting of a relay contacts controlled by means of a relay coil further includes a pair of triacs controlled by an optical switch. The high speed response is attributed to the configuration of the triacs while high ampere rating is provided by the contacts.

14 Claims, 1 Drawing Sheet

HYBRID PROTECTIVE RELAY HAVING ENHANCED CONTACT RESPONSE TIME

BACKGROUND OF THE INVENTION

When protective relays are used within electrical power transmission systems in an overload protection capacity, the relay must rapidly respond without delay to insure that the associated transmission equipment is unharmed.

State of the art protective relays include a circuit to overdrive a conventional electromagnetic relay by using a higher voltage than the relay coil design specifies and then limiting the current either by an electronic current source in the coil circuit or by shorting a series resistor in the coil circuit and using a semiconductor switch such as a thyristor to decrease the relay overall response time.

A second approach includes a pair of relay contacts one of which is normally closed to provide an initial high current path into the relay coil. Once the relay contacts begin to move, the normally closed contacts open, removing the higher current from the coil. A hold-in series resistor provides continued drive after the relay closes.

A further approach uses thyristors in place of the relay contacts as the switching devices. Turn-on time for thyristors can be very fast and state-of-the-art thyristors can handle large currents instantaneously. However, the thyristors must be sized to limit power loss associated with the large quiescent currents within electrical power transmission systems and must be polarized with respect to the direction of current flow.

U.S. Pat. No. 5,079,457 entitled "Dual Solid State Relay" describes the use of solid state relays that employ both Triacs and SCRs in protective relay applications.

U.S. Pat. No. 5,162,682 entitled "Solid State Relay Employing Triacs and a Plurality of Snubber Circuits" discloses the use of an optical coupler combined with a triac and a snubber circuit to protect electrical equipment.

U.S. Pat. No. 5,338,991 entitled "High Power Solid State Relay with Input Presence and Polarity Indication" describes the application of an optical coupler with a solid state Darlington circuit to provide solid state relay function.

Such solid state relays, however, are generally expensive, do not provide adequate ohmic isolation and require particular attention to polarity during installation within the protected circuit.

Recent approaches to the combination of custom relay contacts with custom semiconductor switches for specific applications are found in U.S. Pat. No. 4,992,904 entitled "Hybrid Contactor for DC Airframe Power Supply" and U.S. Pat. No. 5,536,980 entitled "High Voltage High Current Switching Apparatus".

In view of the excellent properties of conventional protective relays employing standard coils and contacts to cover a wide range of operating currents, is would be highly advantageous to modify the response time thereof to allow use within those applications requiring immediate contact separation.

One purpose of the invention is to provide a hybrid protective relay having the fast response features of a solid state relay while retaining the low cost and high performance of an electromagnetic protective relay.

SUMMARY OF THE INVENTION

A protective relay of the type consisting of a pair of relay contacts controlled by means of a relay coil further includes a triac controlled by an optical switch. The high speed response is attributed to the configuration of the triac while high ampere rating is provided by the contacts. Fault tolerant operation is further provided by the arrangement whereby the contacts can remain operational upon the event of failure of the semiconductor switch. A simple replaceable fuse provides ohmic isolation if the semiconductor switch fails in the shorted mode.

DESCRIPTION OF THE PREFERRED EMBODIMENT

Figure 1:
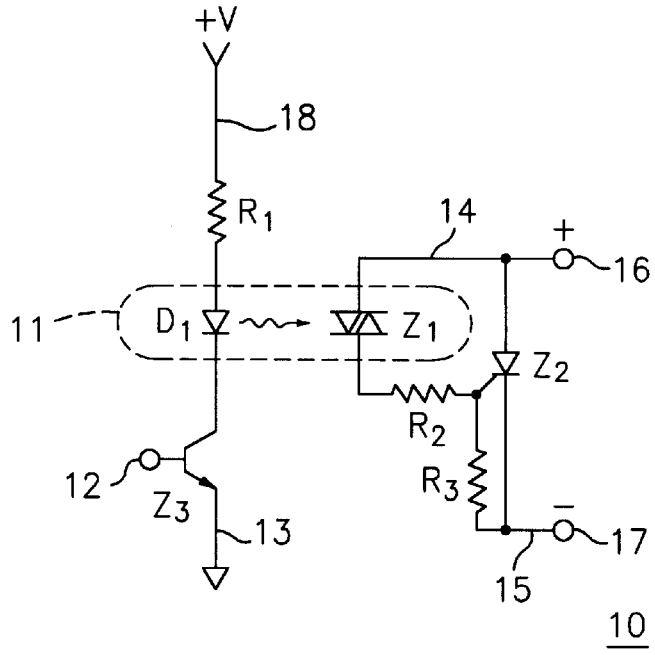
FIG. 1 (PRIOR ART)
FIG. 1 is a diagrammatic representation of a solid state protective relay according to the Prior Art.

Before describing the protective relay of the invention, it is helpful to review the operation of a solid state relay 10 as described in aforementioned U.S. Pat. No. 5,079,457 and depicted in FIG. 1 (similarly numbered features appear in both FIGS. 1 and 2). A control conductor 18 connects between a voltage source+V, current limiting resistor $R_1$ and ground as indicated at 13 and includes an optical switch 11 in the form of a light emitting diode $D_1$ and photo-responsive triac $Z_1$, as indicated. A voltage signal is applied to the terminal 12 connecting with the base of a transistor switch $Z_3$ to initiate interruption of the circuit transferring through terminals 16, 17. One side of the triac $Z_1$ connects with terminal 16 over conductor 14 and the other side of the triac connects with the gate of the SCR $Z_2$ through one of the voltage divider resistors $R_2$. The other voltage divider resistor $R_3$ connects between the gate of SCR $Z_2$ and terminal 17 via conductor 15. The cathode of the SCR $Z_2$ directly connects with the terminal 17. As described earlier, the SCR $Z_2$ is in circuit with the protected circuit and continually draws circuit current to develop considerable I2R heating over long periods of time and is sized to handle overcurrent circuit current for a very short time period and the polarity of the circuit connections with the cathode and anode of the SCR must be arranged as indicated herein. An output signal developed across the terminals 16, 17 then actuates an associated contactor or circuit breaker to interrupt the circuit current.

Figure 2:
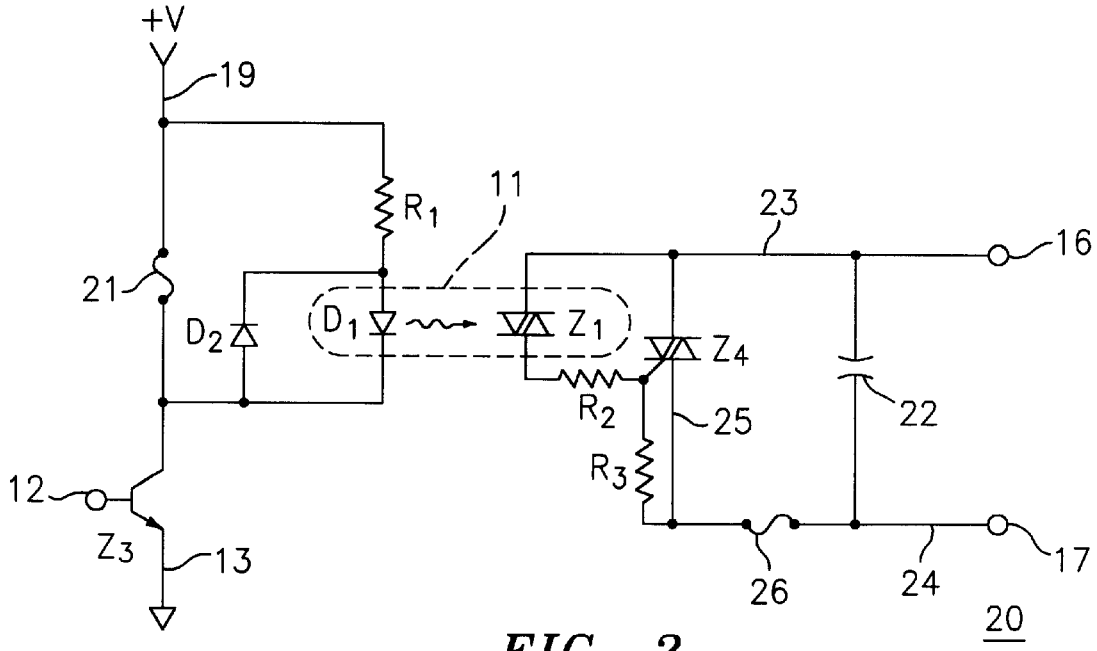
FIG. 2 is a diagrammatic representation of a hybrid protective relay according to the invention.

The hybrid protective relay 20 according to the invention is shown in FIG. 2 and consists of a conventional electromagnetic protective relay consisting of a relay coil 21 governing the OPEN and CLOSED conditions of an associated pair of contacts 22. The relay * operates in the manner described within U.S. Pat. No. 5,057,962 entitled "Microprocessor-Based Protective Relay System" whereby a current supplied to the relay coil articulates the relay contacts to the closed position. The circuit operates in a manner similar to that described in FIG. 1 and similar reference numerals will be applied where convenient. A transistor switch $Z_3$ is base-connected with a terminal 12 and is emitter-connected with ground. A similar optical switch 11 containing a light emitting diode $D_1$ and photo-responsive triac $Z_1$ responds to current flow through the current limiting resistor $R_1$ within the conductor 19. The photo-responsive triac $Z_1$ connects with the gate of a second triac $Z_4$, one side of the contacts 22, and terminal 16 over conductor 23. The anode of the second triac connects with the other side of the photo-responsive triac $Z_1$ over resistor $R_2$ and the gate of the second triac $Z_4$ connects over conductor 25 to a fuse 26, one side of the contacts 22 and terminal 17 over conductor 24.

A reverse diode $D_2$ across the light emitting diode $D_1$ protects the photodiode and the relay coil 21 when the voltage is reversed momentarily upon removal of the signal from the terminal. The hybrid protective relay 20 exhibits the contact response speed of the prior art solid state relay 10 of FIG. 1 at a substantial reduction in both component cost as well as on-site installation time and complexity.

The hybrid protective relay 20 operates in the following manner. A voltage signal applied to the base of the transistor switch $Z_3$ over input 12 turns on the transistor and allows current to flow through both the relay coil 21 and the transistor switch $Z_3$ to turn on the photo-responsive triac $Z_1$ as well as the second triac $Z_4$. After the second triac turns on to carry circuit current to the terminals 16, 17, the contacts 22 close. The lower resistance of the contacts diverts the current from the second triac to turn off the second triac. During the period in which the relay contacts are moving to the closed position, the output current increases in the triac circuit, speeding the operation of the output circuit interruption device such as a circuit breaker (not shown). The rapid transfer of increased output control current by the hybrid relay circuit is an important feature of the invention for the following reasons. When the contacts close, they tend to "bounce" which a potential cause of relay failure in state-of-the-art protective relays, as described earlier, due to welding when the circuit is disconnected and re-connected. The contacts under these circumstances are subjected to voltages greater than the output circuit voltage due to circuit inductance. The components within the hybrid protective relay 20, such as the photo-responsive triac $Z_1$ and second triac $Z_4$ are selected to provide a fast parallel current path to the contacts 22 which prevents the voltage from rising significantly across the contacts during the "bounce" occurrence. Once the contacts settle, the current has completely transferred through the contacts and away from the photo-responsive triac $Z_1$ and second triac $Z_4$. When the transistor switch $Z_3$ turns off, current is removed from both the light emitting diode $D_1$ within the optical switch 11 as well as the relay coil 21. The inductive reversal of the relay coil raises the voltage at the collector of the transistor switch $Z_3$. The imposition of the reverse diode $D_2$ protects the relay coil and the light emitting diode $D_1$ from the induced voltage reversal as described earlier. As described in aforementioned U.S. Pat. No. 5,162,682 Snubber circuits in the form of resistors and capacitors are used to protect the triacs from rapid changes in circuit voltage.

A further advantage of the invention is the fault tolerant feature afforded the use of the triacs $Z_1$, $Z_4$ in parallel with the contacts 22. In the event the either of the triacs fail to turn on, the contacts 22 still operate, although with some delay. If the triacs become shorted, the fast fuse 26 operates to disconnect the triacs from the circuit.

It has further been determined, that the fast response time between the receipt of a control signal and the rapid turn-on of the triacs allows the hybrid protective relay of the invention to be used within a high speed communication bus. One such communications bus being described in U.S. Pat. No. 4,817,037 entitled "Data Processing System with Overlap Bus Cycle Operations".

I claim:

1. A protective relay, comprising:

an electromagnetic coil arranged for separating a pair of contacts upon command, said contacts being connected across first and second output terminals;

a photoelectric switch arranged in parallel with said coil;

an electronic switch arranged in series with said coil for energizing said coil and separating said contacts; and a series connection of a semiconductor switch and a semiconductor switch protection fuse, said series connection being arranged in parallel with said contacts and said semiconductor switch being gated by said photoelectric switch, whereby said semiconductor switch turns on prior to complete closure of said contacts;

wherein said semiconductor switch protection fuse connected in series with said semiconductor switch disconnects said semiconductor switch if said semiconductor switch becomes shorted.

2. The protective relay of claim 1 including a first resistor connecting between said photoelectric switch and said semiconductor switch.

3. The protective relay of claim 2 including a second resistor connecting between said semiconductor switch and said second output terminal.

4. The protective relay of claim 1 including a reverse diode connecting across said photoelectric switch to protect said switch from reverse voltage conditions.

5. The protective relay of claim 1 wherein said photoelectric switch includes a photodiode.

6. The protective relay of claim 1 wherein said photoelectric switch includes a first triac.

7. The protective relay of claim 1 wherein said electronic switch comprises a transistor.

8. The protective relay of claim 1 wherein said semiconductor switch comprises a second triac.

9. The protective relay of claim 1, wherein the first and second output terminals connect with a data communications bus of a data processing system.

10. A protective relay, comprising:

an electromagnetic relay coil controlling a pair of contacts, said contacts being connected across a first output terminal and a second output terminal and said relay coil being adapted to receive a turn-on current signal;

a photoelectric switch connected in parallel with said relay coil, said photoelectric switch becoming turned on upon receipt of said turn-on current signal;

an electronic switch connected in series with said relay coil, said electronic switch being adapted for receiving a turn-on voltage signal for initiating said turn-on current signal to said relay coil; and a series connection of a semiconductor switch and a semiconductor switch protection fuse, said series connection being connected in parallel with said contacts, said semiconductor switch becoming turned on with said photoelectric switch whereby said semiconductor switch becomes turned on before said contacts becomes closed to provide output signals to said first and second output terminal.

11. The protective relay of claim 10 wherein said electronic switch comprises a transistor, said transistor being connected in series with said relay coil and having a base adapted for receiving said turn-on voltage.

12. The protective relay of claim 10 wherein said photoelectric switch comprises a photo-diode and a first photo-responsive triac responsive to said photodiode.

13. The protective relay of claim 12 wherein said semiconductor switch comprises a second triac connected in parallel with said first photo-responsive triac and said contacts.

14. The protective relay of claim 13 including a fuse connected in series with said second triac and said second terminal to protect said photoelectric switch and said semiconductor switch from overcurrent and overvoltage conditions.

* * * * *